US011475740B2

(12) United States Patent
Labiak

(10) Patent No.: US 11,475,740 B2
(45) **Date of Patent: *Oct. 18, 2022**

(54) MODIFIED POKER CARD GAME AND COMPUTER SYSTEM FOR IMPLEMENTING SAME

(71) Applicant: John Labiak, Brigantine, NJ (US)

(72) Inventor: John Labiak, Brigantine, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/203,945

(22) Filed: Mar. 17, 2021

(65) Prior Publication Data

US 2021/0201628 A1 Jul. 1, 2021

Related U.S. Application Data

(63) Continuation of application No. 16/583,865, filed on Sep. 26, 2019, now Pat. No. 10,991,210.

(51) Int. Cl.
*G07F 17/32* (2006.01)

(52) U.S. Cl.
CPC ..... *G07F 17/3293* (2013.01); *G07F 17/322* (2013.01); *G07F 17/3272* (2013.01)

(58) Field of Classification Search
CPC .. A63F 1/00; A63F 2001/005; A63F 3/00157; G07F 17/3293
See application file for complete search history.

(56) References Cited

U.S. PATENT DOCUMENTS

| | | | | |
|---|---|---|---|---|
| 5,489,101 | A * | 2/1996 | Moody | A63F 3/00157 D21/369 |
| 5,657,993 | A | 8/1997 | Merlino et al. | |
| 5,882,260 | A | 3/1999 | Marks et al. | |
| 9,564,016 | B2 * | 2/2017 | LaDuca | G07F 17/3293 |
| 10,109,156 | B2 | 10/2018 | LaDuca et al. | |
| 10,366,579 | B2 | 7/2019 | Steinberg | |
| 2015/0379821 | A1 * | 12/2015 | LaDuca | A63F 1/00 463/13 |
| 2017/0169668 | A1 | 6/2017 | LaDuca et al. | |

* cited by examiner

*Primary Examiner* — Seng H Lim
(74) *Attorney, Agent, or Firm* — Fox Rothschild LLP

(57) ABSTRACT

A computer program product for playing a card game is disclosed. The program causes a display device to display a game substrate having one or more player positions, each player position including a bet placement zone indicia layout and a card indicia layout having a card frames arranged in a Z-pattern. The Z-pattern represents a pattern and sequential order in which game cards, when dealt, are placed on the substrate. A substrate for playing such a card game is also disclosed.

19 Claims, 11 Drawing Sheets

400

Z Poker Top, Middle and Bottom Line Bet Pay Table

| HAND | ANTE BETS PAY | TOP, MIDDLE & DOWN BETS PAY |
|---|---|---|
| Royal flush | 1 | 500 to 1 |
| Straight flush | 1 | 100 to 1 |
| Four of a kind | 1 | 40 to 1 |
| Full house | 1 | 12 to 1 |
| Flush | 1 | 8 to 1 |
| Straight | 1 | 5 to 1 |
| Three of a kind | 1 | 3 to 1 |
| Two pair | 1 | 2 to 1 |
| High pair (J-A) | 1 | 1 to 1 |
| Low pair (6-10) | Push | Push |

FIG. 4

500

Z Poker Four Corners Bonus Bet Pay Table

| HAND | PAYS |
|---|---|
| Royal flush | 100 to 1 |
| Four of a Kind | 50 to 1 |
| Straight Flush | 40 to 1 |
| Flush | 6 to 1 |
| Straight | 4 to 1 |
| Three of a kind | 3 to 1 |
| Two pair | 2 to 1 |
| Jacks or better | 1 to 1 |

FIG. 5

600

Z Poker Seven Card Bonus Bet Pay Table

| HAND | PAYS |
|---|---|
| Royal flush | 300 to 1 |
| Straight flush | 100 to 1 |
| Four of a kind | 40 to 1 |
| Full house | 15 to 1 |
| Flush | 10 to 1 |
| Straight | 6 to 1 |
| Three of a kind | 4 to 1 |
| Two pair | 3 to 1 |
| Sixes or better | 1 to 1 |

FIG. 6

MODIFIED POKER CARD GAME AND COMPUTER SYSTEM FOR IMPLEMENTING SAME

CROSS-REFERENCE TO RELATED APPLICATIONS

This application is a continuation of U.S. application Ser. No. 16/583,865, filed Sep. 26, 2019, which is incorporated herein by reference in its entirety.

BACKGROUND

The present disclosure relates generally to games, and more particularly, to a modified poker card game, and a computer system for playing the modified poker card game. Special features are provided to enhance game play.

The growth of the gaming industry, in particular, gambling casinos has been very significant over the last decade. The industry has come to recognize the need for new games and new gambling concepts.

A problem with introducing new games has always been the basic criteria for mass-market gambling, which favor: (a) easy to-learn game rules; (b) strategies that are easy to master and that do not favor "the expert" disproportionately; (c) a short duration between the start (the bet) and the finish (the payoff); (d) the ability to place multiple wagers during each game's short duration; (e) an enticing payoff structure; (f) a game that is fair such that the casino should not have an unreasonable advantage; and (g), notably, the game must be "secure" (i.e., resistant to cheating and tampering).

Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

This document describes devices and methods that are directed to resolving at least some of the issues described above.

SUMMARY

In various embodiments, a substrate for playing a community poker-type card game may include a seven card layout in a Z-pattern. The Z-pattern may have a first row of three card frames, a second row of one single card frame, and a third row of three card frames. The first row may include a card number 1 spot, a card number 2 spot, and a card number 3 spot. The second row may include a card number 4 spot that is positioned directly below the card number 2 spot. The third row may include a card number 5 spot, a card number 6 spot, and a card number 7 spot. The Z-pattern may be defined by the card number 5 spot being below the card number 1 spot, the card number 6 spot being below the card number 2 spot and directly below the card number 4 spot, and the card number 7 spot being below the card number 3 spot.

In various embodiments, a method of playing a community poker-type card game may include the steps of each player placing a token into at least one token receiving zone on a substrate, dealing seven cards face down in the Z-pattern, dealing two face down cards to each player, asking each player to observe their two cards and decide to continue playing or to fold, turning over the seven cards one at a time while continue to ask each player to continue playing or to fold, and finally paying out each remaining player having winning hands determined in accordance with a set of rules governing play.

In some embodiments, the game may be played with a card deck of at least fifty-two physical playing cards.

In some embodiments, the substrate may have a plurality of token receiving zones 1A, 2A, 3A, 4, 5 and 6. A token placed in token receiving zone 1A allows for play along a top line of the Z-pattern. The player's two cards in combination with the three cards of the top line determines a winning hand, a push hand, or a losing hand. A token placed in token receiving zone 2A allows for play along a middle line of the Z-pattern. The player's two cards in combination with the three cards of the middle line determines a winning hand, a push hand, or a losing hand. A token placed in token receiving zone 3A allows for play along a bottom line of the Z-pattern. The player's two cards in combination with the three cards of the bottom line determines a winning hand, a push hand, or a losing hand.

In some embodiments a token placed in token receiving zone 4 allows for bonus play along the four corners of the Z-pattern. The four corner cards determines a winning hand or a losing hand. A token placed in token receiving zone 5 allows for play along the seven cards of the Z-pattern. The seven cards determines a winning hand or a losing hand.

In alternate embodiments a token placed in token receiving zone 6 allows for an optional play. Any winning top line bet, middle line bet, or bottom line bet is matched if a token is placed in the token receiving zone 6.

In some embodiments, the substrate may include indicia for the seven card frames in the Z-pattern, a dealer position, and at least one player position. Each player position may further include indicia for zone 1A, zone 1B, zone 2A, zone 2B, zone 3A, zone 3B, zone 4, zone 5, zone 6, and two player cards. The substrate may further include indicia for a payout table for zone 1A, zone 1B, zone 2A, zone 2B, zone 3A, and zone 3B, a payout table for zone 4, and a payout table for zone 5.

In some embodiments, the token may be one or more items of currency. Alternatively, the token may be one or more playing chips.

In some embodiments, the method is implemented by a computer program product.

BRIEF DESCRIPTION OF THE DRAWINGS

FIG. 1A illustrates a top view of a modified poker game layout on a semicircular substrate, according to an embodiment, while

FIG. 3A illustrates a top view an example bet placement layout, while

FIG. 4 illustrates a top view an example first pay table.

FIG. 5 illustrates a top view an example second pay table.

FIG. 6 illustrates a top view an example third pay table.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The terms "about" or "approximately," when used in connection with a numeric value, are intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

When used in this document, terms such as "above," "below," "left," "right," "top," "middle," and "bottom," are intended to have absolute orientations intended to describe relative positions of various components with respect to each other as viewed from a card game player (hereinafter player). For example, a first card may be "above" a second card as viewed by a player whereas the first card would be "below" the second card as viewed by the dealer. The claims are intended to include the orientation as viewed by a player of a device containing such components.

Figure 1A:
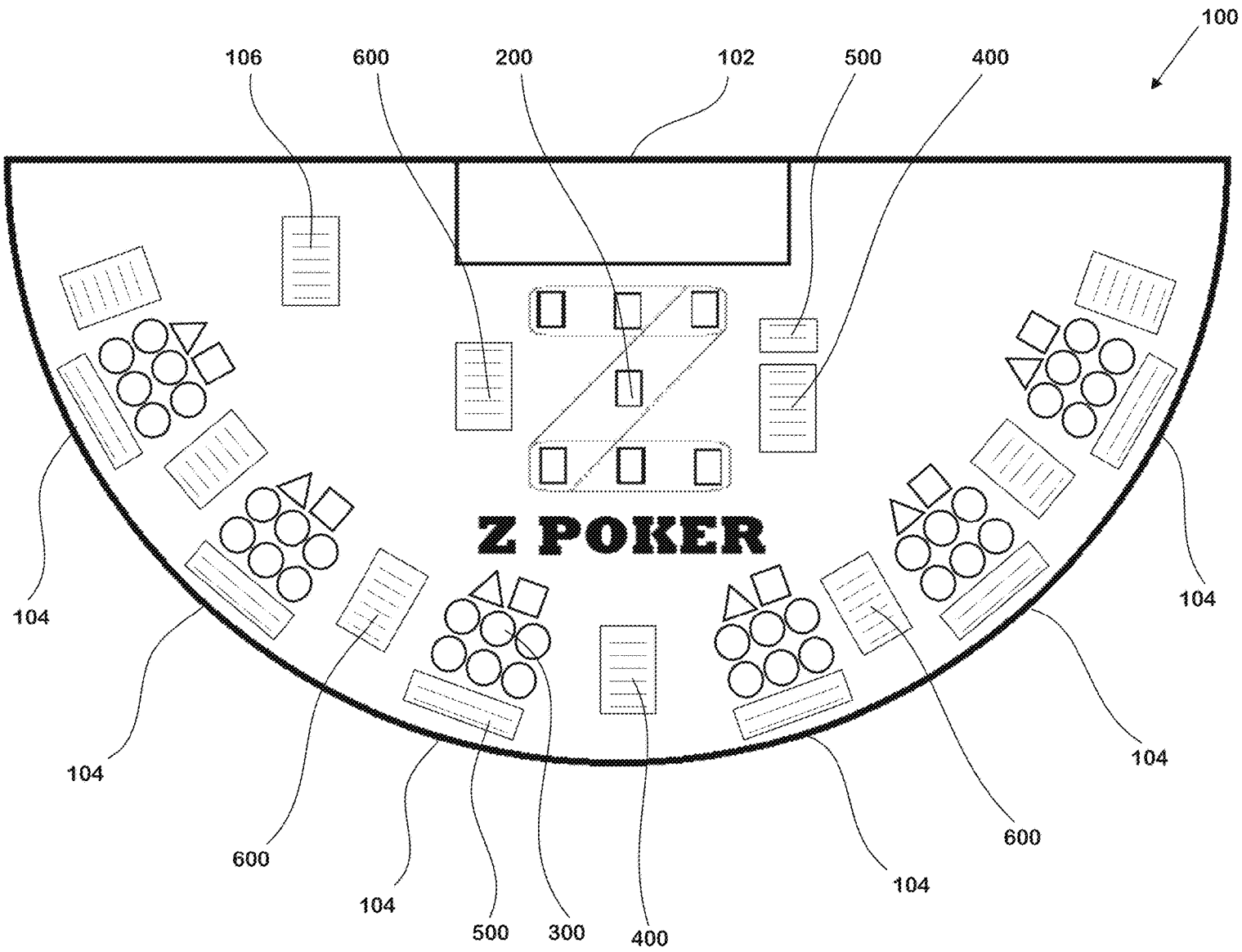
Figure 1B:
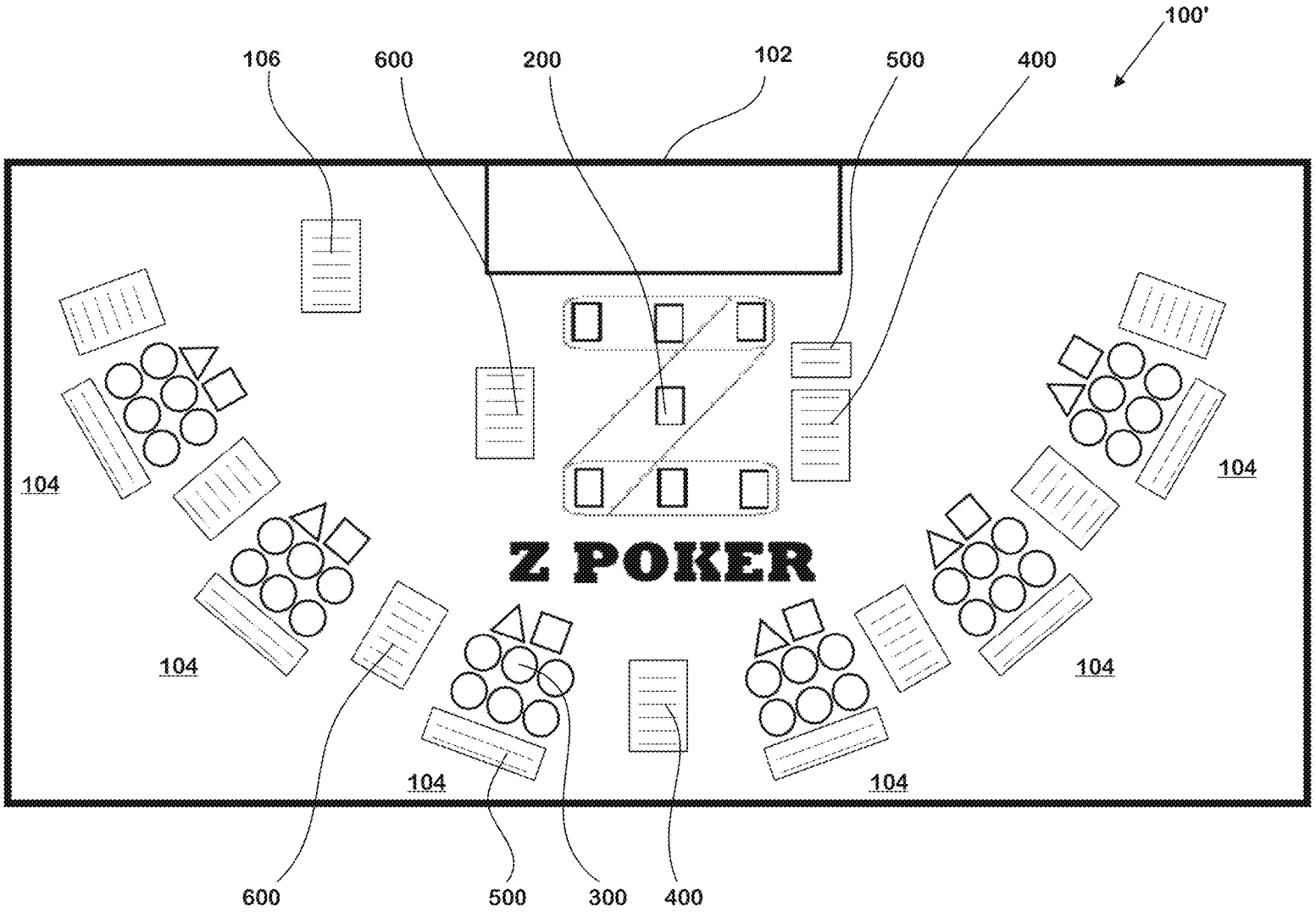
FIG. 1B illustrates a top view of a similar modified poker game layout on a rectangular substrate.

FIG. 1A illustrates a top view of an example modified poker game layout on a semicircular substrate 100, according to an embodiment, while FIG. 1B illustrates an example top view of a similar modified poker game layout on a rectangular substrate 100'. The substrate 100, 100' (hereinafter referred to as 100 unless otherwise designated) may be any surface that includes a layout of seven community card frames 201-207 placed in a Z-pattern 200 as will be described in more detail below. The substrate 100 may optionally include one or more bet placement layouts 300, one or more informational pay tables 400, 500, 600, one or more casino rule lists (i.e., minimum and maximum wagers) 106, or the like, as will be described in more details below.

For example, a substrate 100 may be a casino table with a dealer position 102 on one side of the casino table and one or more player positions 104 on the other side or sides (if more than two sides) of the table. For example, six player positions 104 are illustrated in FIGS. 1A and 1B opposite one dealer position 102. Likewise, the substrate 100 may be a sheet of paper or felt, a board, a table, or the like. The substrate 100 may be placed atop a support surface, such as table, or may include adjustable legs to allow for seating or standing of players. The substrate 100 may be able to be folded for storage with seams, folds, living hinges, mechanical hinges, or the like. The substrate 100 may likewise be rolled for storage. The substrate 100 may be packaged as a game set included with a rules sheet, a deck of playing cards, a set of tokens, or the like. A token may be any item placed by a player onto the substrate. The token may designate a wager type or amount. For example, the token may be a casino chip, a color-coded chip, paper currency, coin currency, or the like. The substrate 100 may include indicia to distinguish this substrate from other poker-style substrates. For example, an indicia 'Z POKER' may be located on the substrate 100 to designate the game type.

Figure 2:
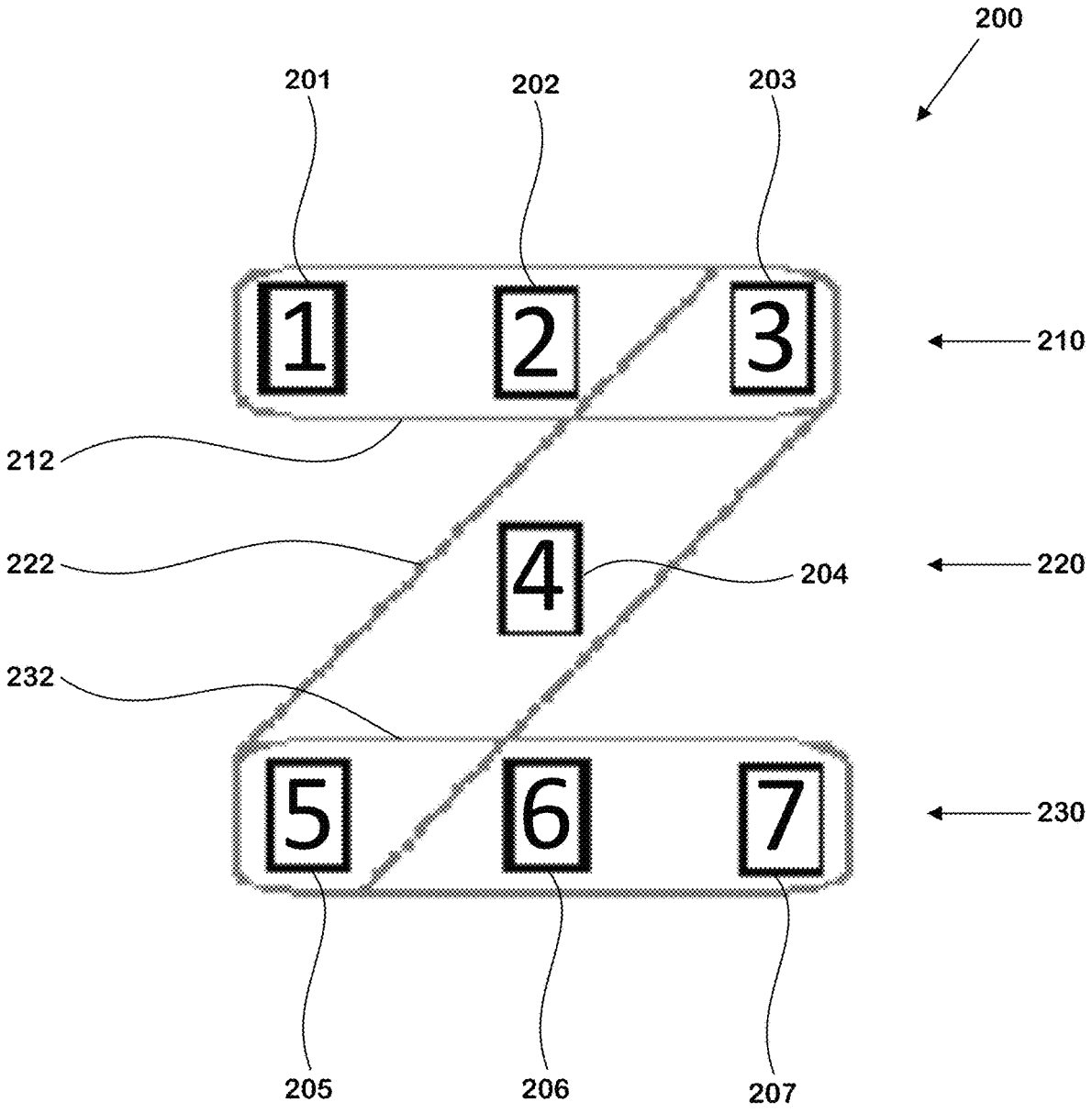
FIG. 2 illustrates a top view of an example layout of seven community card frames placed in a Z-pattern.

FIG. 2 illustrates a top view of an example layout of the seven community card frames 201-207 placed in the Z-pattern 200. The Z-pattern 200 of seven community card frames 201-207 may include indicia to designate each card frame. For example, an indicia '1' may be in the first card frame 201, an indicia '2' may be in the second card frame 202, as so on. The top three card frames 201-203 may include a first marked perimeter 212 to designate the three card frames 201-203 as included in a top line 210 of card frames. The diagonal three card frames 203-205 may include a second marked perimeter 222 to designate the three card frames 203-205 as included in a middle line 220 of card frames. The bottom three card frames 205-207 may include a third marked perimeter 232 to designate the three card frames 205-207 as included in a bottom line 230 of card frames. The top line 210, middle line 220, and bottom line 230 are orientated, as viewed by each player, as the Z-pattern 200.

Figure 3A:
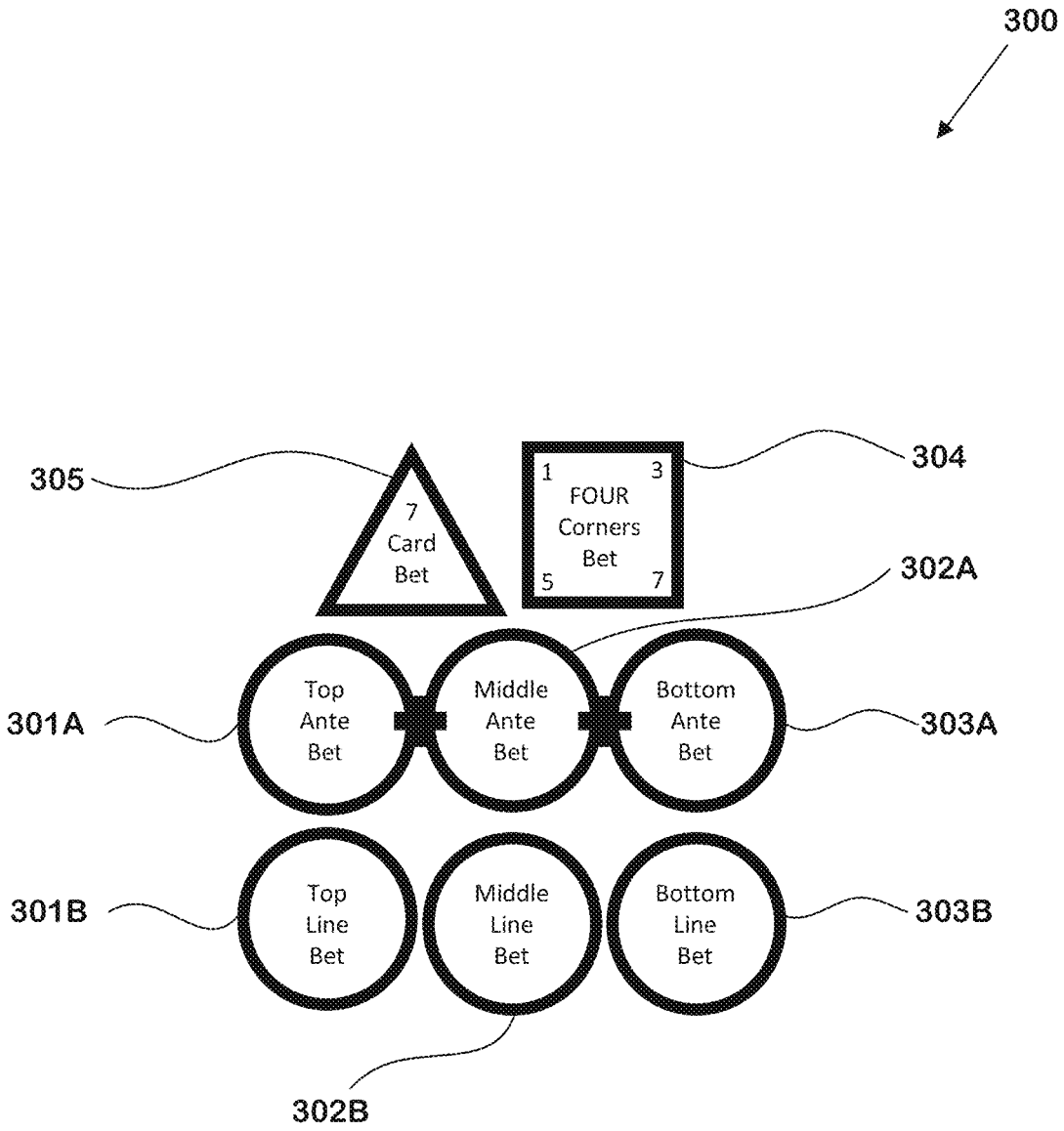
Figure 3B:
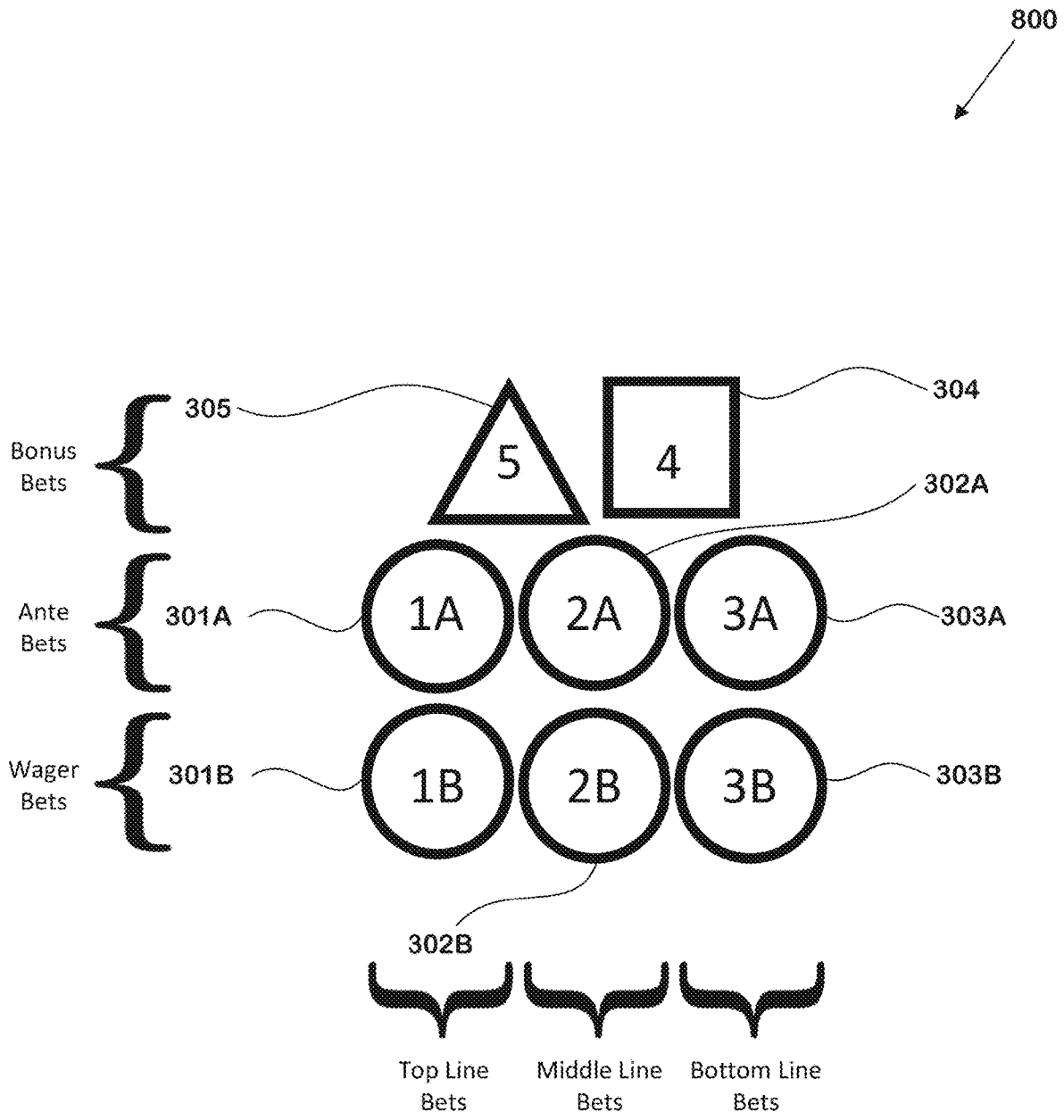
FIG. 3B illustrates another example of a bet placement layout similar to FIG. 3A.

FIG. 3A illustrates a top view of an example bet placement layout 300. The bet placement layout 300 may include one or more zones into which a player may place a token. For example, the bet placement layout 300 may include a top row including two bet placement zones 304 and 305, a middle row including three bet placement zones 301A, 302A, and 303A, and a bottom row of bet placement zones 301B, 302B, and 303B. FIG. 3B illustrates another example of a bet placement layout similar to FIG. 3A.

Zones 304 and 305 may designate two bonus bet placement zones. For example, a first bonus bet may be a Four Corners Bet and a second bonus bet may be a Seven Card Bet (as both will be described in more detail below). An indicia 'FOUR Corners Bet' or '4' may be in the first bonus bet zone 304 and an indicia '7 Card Bet' or '5' may be in the second bonus bet zone 305 to distinguish the type of bonus bet, as viewed by a player. Optionally, indicia '1,' '3,' '5,' and '7' may be positioned in the corners of the first bonus bet zone 304, as viewed by a player. Optionally, the first bonus bet zone 304 may have a square frame and the second bonus bet zone 305 may have a triangular frame.

Zones 301A, 302A, and 303A may designate three ante bet placement zones. For example, a first ante bet may be a Top Line Ante Bet, a second ante bet may be a Middle Line Ante Bet, and a third ante bet may be a Bottom Line Ante Bet. An indicia 'Top Ante Bet' or '1A' may be in the first ante bet zone 301A, an indicia 'Middle Ante Bet' or '2A' may be in the second ante bet zone 302A, and an indicia 'Bottom Ante Bet' or '3A' may be in the third ante bet zone 303A to distinguish the type of ante bet, as viewed by a player. Optionally, the ante bet zones 301A, 302A, and 303A may each have a circular frame.

Zones 301B, 302B, and 303B may designate three wager bet placement zones. For example, a first wager bet may be a Top Line Wager Bet, a second wager bet may be a Middle Line Wager Bet, and a third wager bet may be a Bottom Line Wager Bet. An indicia 'Top Line Bet' or '1B' may be in the first wager bet zone 301B, an indicia 'Middle Line Bet' or '2B' may be in the second wager bet zone 302B, and an indicia 'Bottom Line Bet' or '3B' may be in the third wager bet zone 303B to distinguish the type of wager bet, as viewed by a player. Optionally, the wager bet zones 301B, 302B, and 303B may also each have a circular frame.

Figure 3C:
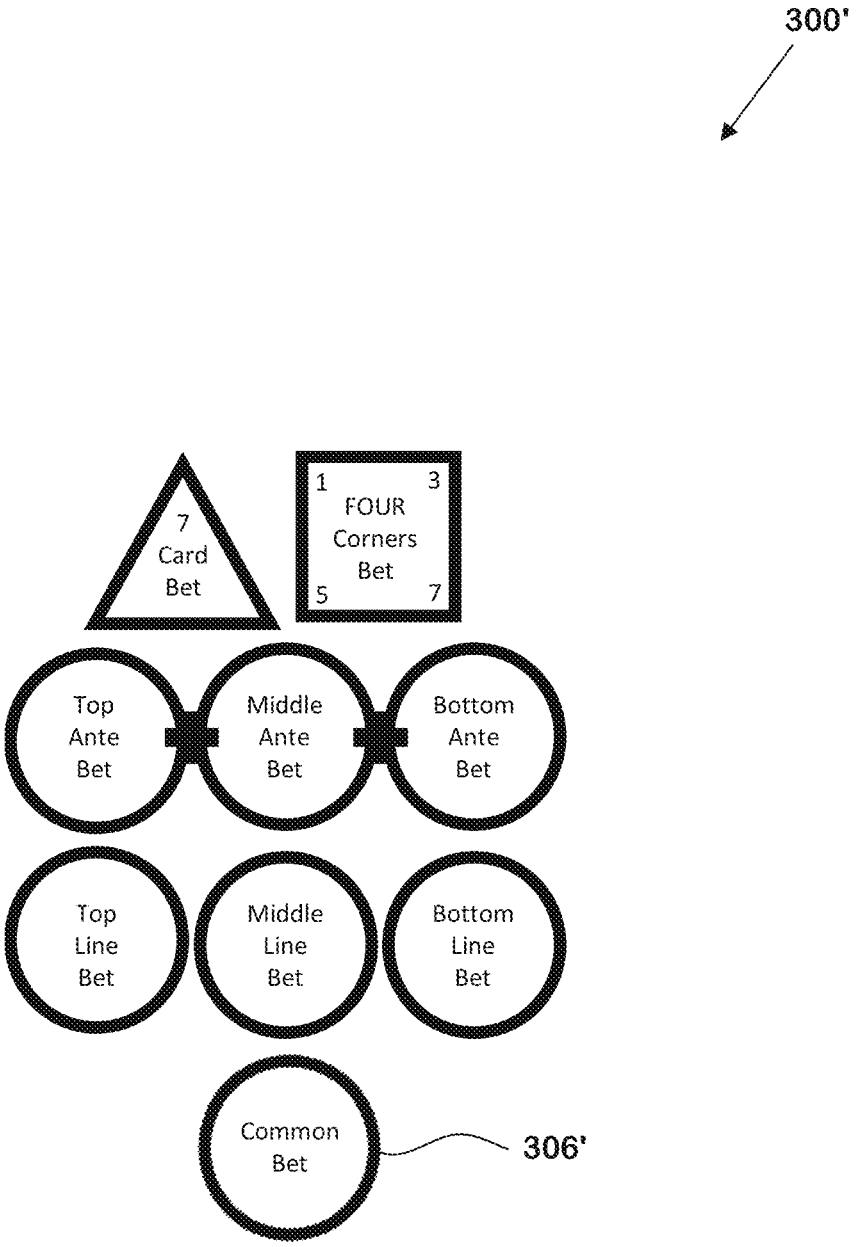
FIG. 3C illustrates a modified example of a bet placement layout.

FIG. 3C illustrates a top view of a modified example bet placement layout 300'. The bet placement layout 300' may include an additional zone 306' into which a player may place a token. Zone 306' may designate an optional bet placement zone. For example, the optional bet placement zone 306' may be a Common Bet. An indicia 'Common Bet' or '6' may be in the optional bet placement zone 306' to distinguish the type of optional bet, as viewed by a player. Optionally, the optional bet placement zone 306' may have a circular frame.

One or more informational pay tables 400, 500, 600 (i.e., agreed upon payout terms and instructions) may be adjacent each player location 104 orientated for every player to read and matching one or more pay tables adjacent the Z-pattern 200 orientated for the dealer to read. FIG. 4 illustrates an example first pay table 400. For example, the first pay table 400 may be a Top, Middle and Bottom Line Bet Pay Table to provide information regarding agreed upon payout terms and instructions for three line bets. First pay table 400 may also provide information regarding agreed upon payout terms and instructions for the optional bet (e.g., the Common Bet), if present. FIG. 5 illustrates an example second pay table 500. For example, the second pay table 500 may be a Four Corners Bonus Bet Pay Table to provide information regarding agreed upon payout terms and instructions for a four corners bonus bet. FIG. 6 illustrates an example third pay table. For example, the third pay table 600 may be a Seven Card Bonus Bet Pay Table to provide information regarding agreed upon payout terms and instructions for a seven cards bonus bet. Optionally, a first pay table 400 and a third pay table 600 may be alternatingly positioned adjacent the left and right side of each bet placement layout 300, as viewed by a player. Likewise, the second pay table 500 may be positioned adjacent the bottom side of each bet placement layout 300, as viewed by a player.

Figure 7A:
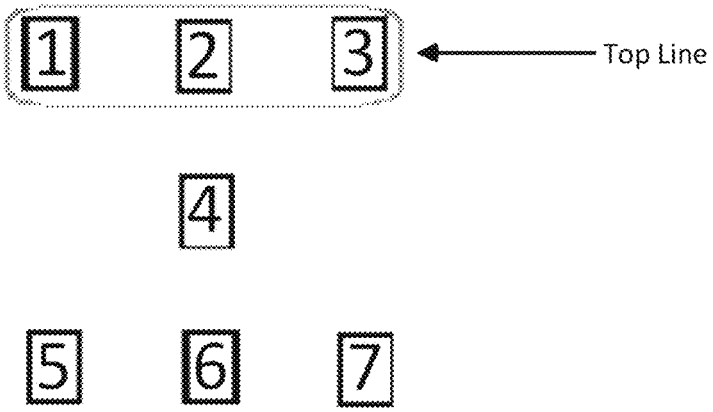
FIG. 7A illustrates the top row of the seven community card frames.
Figure 7B:
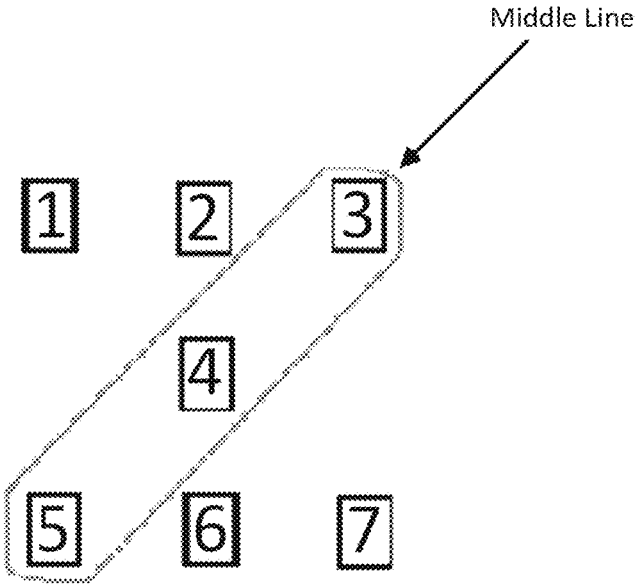
FIG. 7B illustrates the middle row of the seven community card frames.
Figure 7C:
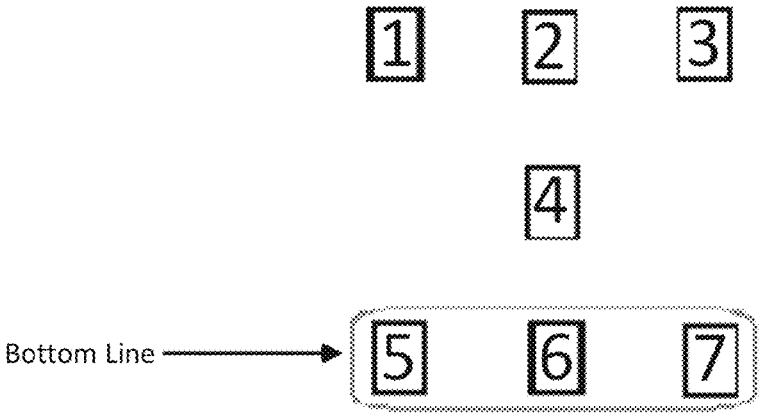
FIG. 7C illustrates the bottom row of the seven community card frames.

FIGS. 7A-7C illustrates the top line 210, middle line 220, and bottom line 230, respectively, of the seven community card frames 201-207, as will be described in more details below.

Rules of Play for Z Poker

Z Poker is a modified poker card game played using a standard, randomized (e.g., shuffled a set number of times; for example, seven times) 52-card deck on the substrate 100 between a dealer and one or more players. Likewise, other card games may be played on the substrate 100. To begin, each player must place tokens in ante bet zones 301A-303A for three ante bets of equal value. Alternatively, the player may be allowed to place a token in one or more ante bet zones 301A-303A. Likewise, the player may be allowed to place unequal token amounts in one or more ante bet zones 301A-303A. Tokens placed in the first ante bet zone 301A correspond to a poker hand consisting of the player's two cards and the top three community cards in the card frames 201-203 of the top line 210 (e.g., a Top Line Bet). Tokens in the second ante bet zone 302A correspond to a poker hand consisting of the player's two cards and the middle three community cards in the card frames 203-205 of the middle line 220 (e.g., a Middle Line Bet). Tokens in the third ante bet zone 303A correspond to a poker hand consisting of the player's two cards and the bottom three community cards in the card frames 205-207 of the bottom line 230 (e.g., a Bottom Line Bet). Optionally, the player may also place tokens in the first bonus bet zone 304, the second bonus bet zone 305, and/or the optional bet zone 306'. Tokens in the first bonus bet zone 304 correspond to a modified poker hand consisting of the four corner community cards in the card frames 201, 203, 205, and 207 (e.g., a Four Corners Bonus Bet). Tokens in the second bonus bet zone 305 correspond to a five-card poker hand selected from the seven community cards in the card frames 201-207 (e.g., a Seven Card Bonus Bet). Tokens in the optional bet zone 306' may be a multiple of the above ante bets in ante bet zones 301A, 302A, and 303A. For example, the multiple may be one-times, two-times, or three-times (e.g., 1X, 2X, 3X) the ante bet or may be selected from a choice of one-times, two-times, and three-times. Alternatively, if the above ante bets are not equal, then the tokens in the optional bet zone 306' may be a multiple of the smallest of the above ante bets. Tokens in the optional bet zone 306' correspond to a matching bet which pays out if any one Top Line Bet, Middle Line Bet, or Bottom Line Bet wins.

The dealer then deals seven random community cards face down in the seven community card frames 201-207 in such a way that they form a Z starting from the first card frame 201 and continuing to the last card frame 207 in sequential order. Each player is then dealt two random player cards face down. Players may examine only their own cards.

The dealer offers each player the option to either make a "Top Line Bet" or to forfeit the player's three ante tokens in the ante bet zones 301A-303A. To make a "Top Line Bet", the player places one or more tokens in the first wager bet zone 301B. Optionally, the "Top Line Bet" may be required to be 1 to 3 times the amount of tokens the player placed in the first ante bet zone 301A. After each player has either forfeited or made the "Top Line Bet", the dealer will reveal (e.g., turn over) the two community cards in card frames 201 and 203 in the top line 210; the community cards in card frames 202 and 204-207 will remain facedown.

The dealer offers each player the next option to either make a "Middle Line Bet" or forfeit all previous wagers (i.e., the player's tokens in the ante bet zones 301A-303A and in the first wager bet zone 301B). To make a "Middle Line Bet", the player places one or more tokens in the second wager bet zone 302B. Optionally, the "Middle Line Bet" may be required to be 1 to 3 times the amount of tokens the player placed in the second ante bet zone 302A. After each player has either forfeited or made the "Middle Line Bet", the dealer will reveal the community card in the card frame 205 in the middle line 220; the community cards in card frames 202, 204, 206, and 207 will remain facedown.

The dealer offers each player the last option to either make a "Bottom Line Bet" or forfeit all previous wagers (i.e., the player's tokens in the ante bet zones 301A-303A, in the first wager bet zone 301B, and in the second wager bet zone 302B). To make a "Bottom Line Bet", the player places one or more tokens in the third wager bet zone 303B. Optionally, the "Bottom Line Bet" may be required to be 1 to 3 times the amount of tokens the player placed in the third ante bet zone 303A. After each player has placed the "Bottom Line Bet", the dealer will reveal the community card in the card frame 207 in the bottom line 230; the community cards in card frames 202, 204, and 206 will remain facedown.

Now that all four corner community cards in card frames 201, 203, 205, and 207 have been revealed by the dealer, the dealer will compare the four corner cards against the agreed upon payout terms and instructions found in the second pay table 500 (e.g., the Four Corners Bonus Bet Pay Table). The dealer will then either pay any player who has a token in the first bonus bet zone 304 (e.g. the Four Corners Bet) for winning card hands or collect all tokens in the first bonus bet zone 304 for losing card hands.

The dealer will then reveal the remaining three community cards in the card frames 202, 204, and 206.

Now that all seven community cards in card frames 201-207 have been revealed by the dealer, the dealer will compare all possible groups of five cards selected from the seven cards and determine the best five-card combination to compare against the agreed upon payout terms and instructions found in the third pay table 600 (e.g., the Seven Card Bonus Bet Pay Table). The dealer will then either pay any player who has a token in the second bonus bet zone 305 (e.g. the 7 Card Bet) for winning card hands or collect all tokens in the second bonus bet zone 305 for losing card hands.

The dealer will then reveal the player's two cards.

The dealer will compare the player's two cards and the three top community cards in card frames 201-203 (i.e., to form a Top Line five-card poker hand) against the agreed upon payout terms and instructions found in the first pay table 400 (e.g., the Top, Middle and Bottom Line Bet Pay Table). The dealer will then either pay any player who has tokens in the first ante bet zone 301A and the first wager bet zone 301B (e.g. the first Ante Bet and the Top Line Bet) for winning card hands, allow the player to have their ante bet remain in play for the next round (e.g., a Push) for neutral hands, or collect all tokens in the first ante bet zone 301A and first wager bet zone 301B for losing card hands.

The dealer will next compare the player's two cards and the three middle community cards in card frames 203-205 (i.e., to form a Middle Line five-card poker hand) against the agreed upon payout terms and instructions found in the first pay table 400 (e.g., the Top, Middle and Bottom Line Bet Pay Table). The dealer will then either pay any player who has tokens in the second ante bet zone 302A and the second wager bet zone 302B (e.g. the second Ante Bet and the Middle Line Bet) for winning card hands, allow the player to have their ante bet remain in play for the next round (e.g., a Push) for neutral hands, or collect all tokens in the second ante bet zone 302A and second wager bet zone 302B for losing card hands.

The dealer will compare the player's two cards and the three bottom community cards in card frames 205-207 (i.e., to form a Bottom Line five-card poker hand) against the agreed upon payout terms and instructions found in the first pay table 400 (e.g., the Top, Middle and Bottom Line Bet Pay Table). The dealer will then either pay any player who has tokens in the third ante bet zone 303A and the third wager bet zone 303B (e.g. the third Ante Bet and the Bottom Line Bet) for winning card hands, allow the player to have their ante bet remain in play for the next round (e.g., a Push) for neutral hands, or collect all tokens in the third ante bet zone 303A and third wager bet zone 303B for losing card hands.

Finally, the dealer will either pay any player who has a token in the optional zone 306' (e.g. the Common Bet) to match any winning payouts from any one Top Line Bet, Middle Line Bet, or Bottom Line Bet winning hands or collect all tokens in the optional bet zone 306' for losing card hands.

Upon completing the above steps for all players, the dealer will again randomize the cards (i.e. shuffle seven times) and ask all players to place their ante bets for the next game. A player has the improved option to play up to five poker hands in this modified poker game in each round (i.e., between each shuffle of the cards) compared to only one hand in the common poker game.

The above method of playing a modified poker card game may also be performed by a computing system having at least one processor, one or more memories, a display, and/or one more computer readable storage media storing computer program instructions. The program instructions may be executable by the computer to perform the above listed steps (e.g., Rules of Play). At least one player will be a real player who provides input via a user interface, such as a microphone or a touch screen display. Optionally, one or more of the additional players may be computer virtual players, and the computer may generate actions for the players, either randomly or by implementing one or more rules. The step of dealing random cards to a Z-pattern of community cards and to each player (both real and virtual) is performed by a random number generating program assigning number one through fifty-two to each different playing card. A real player may simulate placing a token within an ante placement zone or bet zone placement zone by manually pressing (i.e., providing input) a button on a computer peripheral device (e.g., keyboard, mouse, game controller, joystick, or the like), by touching a capacitance readable computer screen (e.g., touchscreen), or the like. A computer display indicates a token placed within the zone after receiving the player's input, and the substrate with the seven card layout described above may be output in graphic format on the display.

Figure 8:
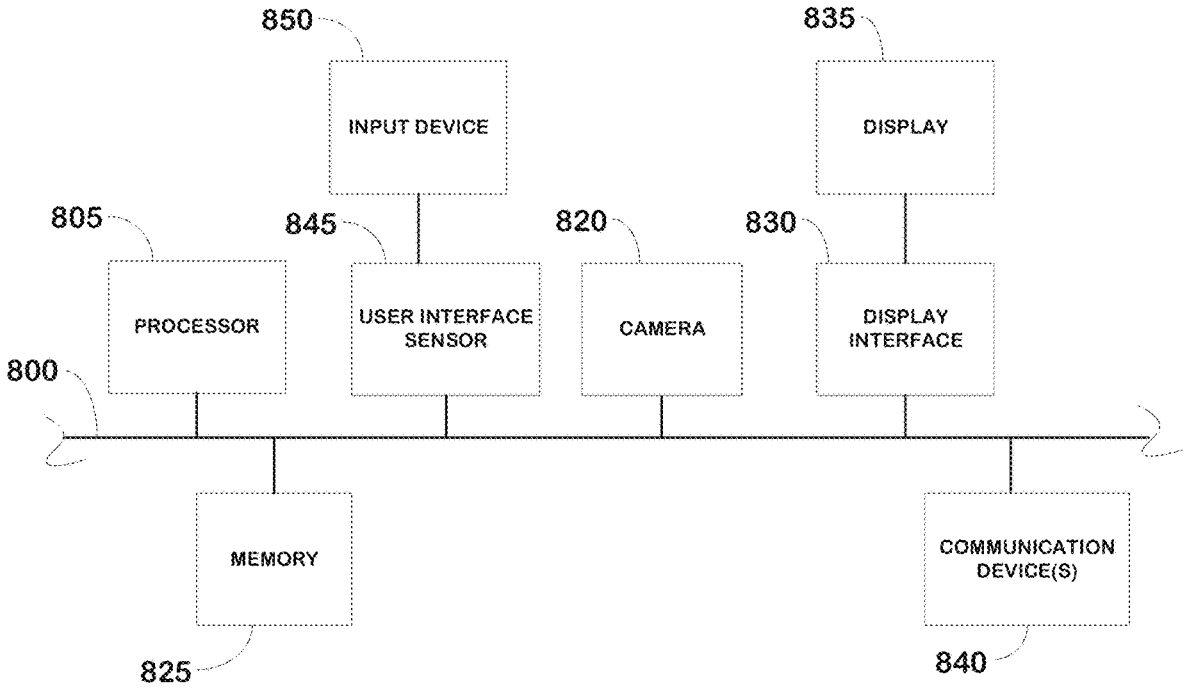
FIG. 8 depicts an example of internal hardware that may be used to contain or implement the various processes and systems as described in this disclosure.

FIG. 8 depicts an example of components of a system that may implement the computer-implemented embodiment described above. An electrical bus 800 serves as an information highway interconnecting the other illustrated components of the hardware. Processor 805 is a central processing device of the system, configured to perform calculations and logic operations required to execute programming instructions. As used in this document and in the claims, the terms "processor" and "processing device" may refer to a single processor or any number of processors in a set of processors that collectively perform a set of operations, such as a central processing unit (CPU), a graphics processing unit (GPU), a remote server, or a combination of these. Read only memory (ROM), random access memory (RAM), flash memory, hard drives and other devices capable of storing electronic data constitute examples of memory devices 825. A memory device may include a single device or a collection of devices across which data and/or instructions are stored.

An optional display interface 830 may permit information from the bus 800 to be displayed on a display device 835 in visual, graphic or alphanumeric format. An audio interface and audio output (such as a speaker) also may be provided. Communication with external devices may occur using various communication devices 840 such as a wireless antenna, an RFID tag and/or short-range or near-field communication transceiver, each of which may optionally communicatively connect with other components of the device via one or more communication system. The communication device 840 may be configured to be communicatively connected to a communications network, such as the Internet, a local area network or a cellular telephone data network.

The hardware may also include a user interface sensor 845 that allows for receipt of data from input devices 850 such as a keyboard, a mouse, a joystick, a touchscreen, a touch pad, a remote control, a pointing device and/or microphone. Digital image frames also may be received from a camera 820 that can capture video and/or still images.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A game, comprising:

a game substrate for playing a card game, the substrate comprising:

one or more player positions, each player position including a bet placement zone indicia layout; and a card indicia layout having a plurality of card frames arranged in a Z-pattern, the Z-pattern represents a pattern and sequential order in which game cards, when dealt, are placed on the substrate, the Z-pattern comprising:

a first row of card frames comprising at least a first playing card frame and a last playing card frame for placement of a first row of the dealt cards, a second row of a card frame comprising one single card frame for placement of a second row of the dealt cards, and a third row of card frames comprising at least a first playing card frame and a last playing card frame for placement of a third row of the dealt cards, wherein the last playing card frame of the first row, the one single card frame of the second row and the first playing card frame of the third row designate a middle line of card frames for a respective player to selectively wager a bet on the dealt game cards placed on the middle line of card frames;

a processor;

a user interface connected to the processor; and a memory device comprising programming instructions that, when executed by the processor, will cause the processor to:

display, on a display device, the game substrate in a graphic format, display, on the display device, the game cards represented as being dealt in the sequential order in the first row of card frames, the second row of card frames, and the third row of card frames, and in response to a user placing a token into a selected bet placement zone of each bet placement zone indicia layout, cause the display device to display the token on the display device.

2. The game according to claim 1, wherein each bet placement zone indicia layout comprises a middle line bet placement zone indicia that designates a location on the substrate to wager the bet associated with the dealt game cards placed on the middle line of the card frames.

3. The game according to claim 1, further comprising:

a deck of the game cards; and a set of tokens for wagering the bet.

4. The game according to claim 1, wherein:

the first playing card frame and the last playing card frame of the first row are first and second corners of the Z-pattern;

the first playing card frame and the last playing card frame of the third row are third and fourth corners of the Z-pattern; and each bet placement zone indicia layout further comprises:

a four corners bet placement zone indicia that is configured to denote a location on the substrate to wager a bet associated with the dealt cards placed on one or more of the first, second, third and fourth corners of the Z-pattern.

5. The game according to claim 4, wherein the four corners bet placement zone indicia comprises a corner bet indicia that is configured to denote a location on the substrate to wager a selected corner bet, the selected corner bet corresponding to a particular numbered card frame of the Z-pattern.

6. The game according to claim 1, wherein:

the first row is a top line of the Z-pattern;

the third row is a bottom line of the Z-pattern; and each bet placement zone indicia layout further comprises:

top line placement zone indicia that is configured to denote a location on the substrate to wager a bet associated with the first row of the dealt cards, and bottom line placement zone indicia that is configured to denote a location on the substrate to wager a bet associated with the third row of the dealt cards.

7. The game according to claim 1, wherein the game is a community poker-type card game.

8. A computer program product for playing a card game, comprising a memory device storing program instructions executable by a processor to perform game play actions comprising:

displaying, via a display device, a game substrate for playing a card game, the substrate comprising:

one or more player positions; each player position including a bet placement zone indicia layout, and a card indicia layout having a plurality of card frames arranged in a Z-pattern, the Z-pattern represents a pattern and sequential order in which game cards, when dealt, are placed on the substrate, the Z-pattern comprising:

a first row of card frames comprising at least a first playing card frame and a last playing card frame for placement of a first row of the dealt cards, a second row of a card frame comprising one single card frame for placement of a second row of the dealt cards, and a third row of card frames comprising at least a first playing card frame and a last playing card frame for placement of a third row of the dealt cards, wherein the last playing card frame of the first row, the one single card frame of the second row and the first playing card frame of the third row designate a middle line of card frames for a respective player to selectively wager a bet on the dealt cards placed on the middle line of card frames;

receiving, via a user interface, a user input representative of an instruction to place a token into a token receiving zone associated with each bet placement zone indicia layout; and causing the display device to display the token on the display device.

9. The computer program product according to claim 8, wherein the program instructions executable by the processor to perform the game play actions further comprise instructions to:

randomize the game cards with a random number generator; and deal on the display device face-down the randomized game cards in the sequential order in the plurality of card frames.

10. The computer program product according to claim 9, wherein the face-down game cards in the plurality of card frames are community cards;

each bet placement zone indicia layout comprises a plurality of token zones for selective betting on at least one of the first row, the middle line and the third row; and the program instructions executable by the processor to perform the game play actions further comprise instructions to:

deal on the display device two randomized game cards to the respective player and one or more additional players, receive, via the user interface, a user input from the respective player representative of an instruction to place a token into a token receiving zone associated with the at least one of the first row, the middle line and the third row, and reveal on the display device the community cards that are in selected card frames of the Z-pattern according to the received user input of the token associated with the at least one of the first row, the middle line and the third row.

11. The computer program product according to claim 10, wherein the program instructions executable by the processor to perform the game play actions further comprise instructions to:

determine a winning hand or a losing hand for the respective player associated with the revealed community cards in accordance with a set of game rules.

12. The computer program product according to claim 11, wherein the program instructions executable by the processor for determining the winning hand or the losing hand for the respective player further comprise instructions to:

combine the randomized game cards of the respective player with the revealed community cards associated with the token in accordance with the set of game rules.

13. The computer program product according to claim 10, wherein one or more of the additional players is a virtual player.

14. The computer program product according to claim 8, wherein the instructions for displaying the game substrate comprise instructions to include, on the display device, indicia for a dealer position.

15. The computer program product according to claim 8, wherein the instructions for displaying the game substrate comprise instructions to include, on the display device, indicia for a payout table for each player position.

16. The computer program product according to claim 8, wherein:

each bet placement zone indicia layout comprises a middle line bet placement zone indicia that denotes a location on the substrate for wagering the bet associated with the dealt cards placed on the middle line of card frames; and the instructions for receiving, via the user interface, the user input representative of the instruction to place the token into one of the plurality of token receiving zones associated with each bet placement zone indicia layout, comprise instructions to include, on the display device, indicia representative of the token placed to wager the bet for the middle line of card frames.

17. The computer program product according to claim 8, wherein:

the first playing card frame and the last playing card frame of the first row are first and second corners of the Z-pattern;

the first playing card frame and the last playing card frame of the third row are third and fourth corners of the Z-pattern;

each bet placement zone indicia layout further comprises:

a four corners bet placement zone indicia that is configured to denote a location on the substrate for wagering a bet associated with dealt cards placed on at least one of the first, second, third and fourth corners of the Z-pattern; and the instructions for receiving, via the user interface, the user input representative of the instruction to place the token into one of the plurality of token receiving zones associated with each bet placement zone indicia layout, comprise instructions to include, on the display device, indicia representative of the token placed to wager the bet for at least one of the first, second, third and fourth corners of the Z-pattern.

18. The computer program product according to claim 8, wherein:

the first row is a top line of the Z-pattern;

the third row is a bottom line of the Z-pattern;

each bet placement zone indicia layout further comprises:

top line placement zone indicia that is configured to denote a location on the substrate to wager a bet associated with the first row of the dealt cards, and bottom line placement zone indicia that is configured to denote a location on the substrate to wager a bet associated with the third row of the dealt cards; and the instructions for receiving, via the user interface, the user input representative of the instruction to place the token into one of the plurality of token receiving zones associated with each bet placement zone indicia layout, comprise instructions to include, on the display device, indicia representative of the token placed to wager the bet for one of the first row and the third row.

19. The computer program product according to claim 8, wherein:

the card game is a community poker-type card game; and the plurality of card frames comprises seven card frames.

* * * * *